United States Patent [19]

Paskowski, Jr. et al.

[11] Patent Number: 4,538,768

[45] Date of Patent: Sep. 3, 1985

[54] PULVERIZER JOURNAL BEARING SYSTEM

[75] Inventors: Frank J. Paskowski, Jr., West Hartford; Peter L. Stanwicks, Newington, both of Conn.

[73] Assignee: Combustion Engineering, Inc., Windsor, Conn.

[21] Appl. No.: 489,279

[22] Filed: Apr. 27, 1983

[51] Int. Cl.[3] ..... B02C 15/04

[52] U.S. Cl. ..... 241/101.2; 241/121; 384/477

[58] Field of Search ..... 308/236, 187.1; 241/101.2, 132, 117–122; D15/143

[56] References Cited

U.S. PATENT DOCUMENTS

| | | | |
|---|---|---|---|
| 3,114,579 | 12/1963 | Isenbarger | 308/187.1 X |
| 3,169,809 | 2/1965 | Pendleton | 308/187.1 X |
| 4,002,299 | 1/1977 | Skalka | 241/132 |

*Primary Examiner*—Mark Rosenbaum

*Attorney, Agent, or Firm*—Arthur E. Fournier, Jr.

[57] ABSTRACT

A journal bearing system (50, 52) particularly suited for use in a bowl mill (10) of the type that is employed for purposes of effecting therewithin the pulverization of material such as coal. The function of the subject journal bearing system (50, 52) is to provide the bearing support for the journal shaft (22, 54) on which the pulverizer roll (20) is mounted that through the coaction thereof with a suitable surface (14) provided for this purpose effects the pulverization of material. The subject journal bearing system (50, 52) includes first bearing means (62, 116) positioned at a first location along the length of the journal shaft (22, 54) so as to be cooperatively associated therewith, second bearing means (80, 128) positioned at a second location along the length of the journal shaft (22, 54) so as to be cooperatively associated therewith, oil seal wear ring means (86, 140) positioned at a third location along the length of the journal shaft (22, 54) so as to be cooperatively associated therewith and air seal ring means (88, 142) cooperatively associated with the upper journal housing (58, 110) and operative for purposes of effecting control over seal air pressure.

6 Claims, 4 Drawing Figures

PULVERIZER JOURNAL BEARING SYSTEM

BACKGROUND OF THE INVENTION

This invention relates to apparatus for pulverizing, i.e., grinding, material, and more specifically to a journal bearing system that is particularly suited for embodiment in a bowl mill wherein the journal bearing system is operative for purposes of providing the bearing support for the journal shaft on which the pulverizer, i.e., grinding, roll is suitably mounted.

It has long been known in the prior art to provide apparatus that is suitable for employment for purposes of effecting the grinding, i.e., pulverization, of materials. More specifically, the prior art is replete with examples of various types of apparatus that have been used heretofore to effect the grinding of a multiplicity of different kinds of materials. In this regard, in many instances discernible differences of a structural nature can be found to exist between individual ones of the aforesaid apparatus. The existence of such differences is in turn attributable for the most part to the diverse functional requirements that are associated with the individual applications in which such apparatus are designed to be employed. For instance, in the selection of the particular type of apparatus that is to be utilized for a specific application one of the principal factors to which consideration must be given is that of the nature of the material that is to be ground in the apparatus. Coal is one such material wherein there exists a need to grind the material in order to render it suitable for use in certain applications. Furthermore, fossil fuel fired power generation systems represent one such application in which it is desired to employ coal, as the source of fuel therefor, and wherein a requirement exists to grind, i.e., pulverize the coal in order to render it suitable for use for this purpose.

To this end, coal has long been recognized as being one of this nation's most abundant sources of fuel. At one time earlier in this century, much of the nation's energy needs were being met through the use of coal. Then, in the degree to which coal was being employed to generate power a decline set in. Much of this decline stemmed from the increased usage of oil and gas as sources of fuel. More recently, the power being generated from the burning of oil and gas has been supplemented by the use of nuclear fuel for power producing purposes. However, with the advent of the oil embargo in the last decade which was accompanied by sharp increases in the price of oil and the existence of restricted oil supplies, and the increased concern, which has since been expressed over the rate at which the world's known oil reserves are being depleted, coal has begun to regain some of the favor, which it once had as a source of fuel to meet the nation's energy needs. To some extent, this has been evidenced in the number of orders, which have been placed in recently past years, for power generation systems that are to be coal fired as well as the extent to which increased interest has been shown in effecting the conversion of existing oil and gas fired power generation systems to coal fired systems.

For purposes of the discussion that follows, the coal fired systems referred to above are considered to consist of essentially the following major operating components: a coal feeder, apparatus for pulverizing the coal, a distribution system for distributing the coal after the pulverization thereof, a furnace in which the coal is to be burned, and the requisite controls for effecting the proper operation of the coal fired power generation system. Of particular interest herein is that portion of the coal fired system, which has been identified above as the apparatus for pulverizing the coal. Coal pulverizing apparatus are not new. They have been known to exist in the prior art for more than half a century. Furthermore, many improvements in the construction and/or mode of operation of coal pulverizing apparatus have been made during this period.

There are a number of features that it is advantageous for any coal pulverizing apparatus to possess, but particularly those which are designed for employment in a coal fired power generation system. Reference is had here to features such as reliability, low power consumption, minimum maintenance and wide range of capacity. In addition, such apparatus advantageously should also be characterized by quiet operation, integrated lubrication systems, convenient adjustment and control of coal flow and fineness, and the ability to handle the high temperature air that is required for high moisture coal.

One particular type of coal pulverizing apparatus, which is to be found in the prior art, that is advantageously characterized by the embodiment therein of the above recited features is an apparatus, most commonly referred to in the industry by the name bowl mill. The latter apparatus obtains its name by virtue of the fact that the pulverization, i.e., grinding, of the coal which takes place therein is effected on a grinding surface that in configuration bears a resemblance to a bowl.

Reference may be had by way of exemplification to U.S. Pat. No. 3,465,971, which issued Sept. 9, 1969 to J. F. Dalenberg, et al., and/or U.S. Pat. No. 4,002,299, which issued Jan. 11, 1977 to C. J. Skalka, both of the latter patents being assigned to the same assignee as the instant application, for a teaching of the nature of the construction and the mode of operation of a prior art form of bowl mill that is suitable for use in a coal fired power generation system to effectuate the pulverization of the coal that is to be burned as fuel therein. As taught by the aforereferenced patents, a bowl mill essentially consists of a body portion in which a grinding table is mounted for rotation, a plurality of grinding rollers that coact with the grinding table to effect the grinding of coal interposed therebetween, coal supply means for feeding to the interior of the bowl mill the coal that is to be pulverized and air supply means for supplying to the interior of the bowl mill the air required in the operation of the latter. In accordance with the mode of operation of such a bowl mill, the coal, which enters the bowl mill, is pulverized by virtue of the coaction of the grinding rollers with the grinding table. After being pulverized, the coal particles are thrown outwardly by centrifugal force whereby the particles are fed into a stream of air that is entering the bowl mill. The stream of air, which now contains pulverized coal particles, flows through a tortuous path that is established in part by the positioning within the bowl mill of a suitably supported deflector means. As the stream of air and coal particles flows along the aforementioned tortuous path, the sharp turns contained therein effects the separation of the coarse coal particles from the air stream. These coarse coal particles are then suitably returned to the grinding table for further pulverization, while the fine coal particles are carried through the bowl mill in the air stream, and exit therefrom along with the air.

In a conventional coal fired power generation system, a multiplicity of bowl mills of the type shown in the aforereferenced patents would commonly be employed for purposes of satisfying the requirements of the system for pulverized coal. By way of example, the capacity of each of the individual bowl mills might be on the order of 100 tons per hour of coal.

Although bowl mills constructed in accordance with the teachings of the aforereferenced patents have under actual operating conditions provided adequate performance to date, a need has nevertheless been evidenced for improvements to be made therein. More specifically, prolonged operation of this type of bowl mill has pointed up the existence of several conditions of an undesirable nature that can arise during the use thereof. One of these pertains to the means by which and the manner in which there is effectuated the bearing support of the journals on which the pulverizer rolls are mounted. To this end, the pulverizer journal systems of the type that commonly have been employed in the bowl mills heretofore have for the most part suffered from one or more of the following undesirable features. Namely, it has been found that the upper bearing has been subjected to high radial loading. On the other hand, it has been found that the lower bearing has been subjected to high thrust loading. Furthermore, it has been found that frequently the upper bearing in existing pulverizer journal bearing systems does not have the capacity required thereof for the loadings encountered thereby during service. In addition, the design of both the oil seal and the air seal has proven to be deficient. Thus, to summarize, a need has, therefore, been evidenced for a new and improved means that would be suitable for employment in a bowl mill for purposes of accomplishing the bearing support for the journals on which the pulverizer rolls are designed to be mounted.

It is, therefore, an object of the present invention to provide a new and improved journal bearing system that is suitably constructed so as to be employable in a bowl mill.

It is another object of the present invention to provide such a journal bearing system for bowl mills wherein the radial loading on the upper bearing thereof has been reduced.

It is still another object of the present invention to provide such a journal bearing system for a bowl mill wherein the thrust loading on the lower bearing thereof has been reduced.

A further object of the present invention is to provide such a journal bearing system for bowl mills wherein the capacity of the upper bearing thereof is increased.

A still further object of the present invention is to provide such a journal bearing system for bowl mills wherein the design of the oil seal has been improved.

Yet another object of the present invention is to provide such a journal bearing system for bowl mills wherein the design of the air seal has been improved.

Yet still another object of the present invention is to provide such a journal bearing system for bowl mills which is suitable for employment in newly constructed bowl mills, while yet being equally well suited for utilization in retrofit applications.

SUMMARY OF THE INVENTION

In accordance with the present invention there is provided a journal bearing system that is particularly suited for employment in a bowl mill of the type that is operative for purposes of effecting the pulverization therewithin of a material such as coal. The function of the subject journal bearing system is to provide the bearing support for the journal shafts on which the pulverizer rolls are mounted. The subject journal bearing system encompasses a journal shaft on which the respective pulverizer roll is mounted, a first journal housing, a first bearing means, a second journal housing, second bearing means, oil seal wear ring means and air seal ring means. The first bearing means is suitably located at a first position along the length of the journal shaft such as to be cooperatively associated with the latter. The positioning of the first bearing means relative to the journal shaft is effected primarily by means of the first journal housing. The second bearing means is suitably located in spaced relation to the first bearing means and at a second position along the length of the journal shaft such as to be cooperatively associated with the latter. The positioning of the second bearing means relative to the journal shaft is effected primarily by means of the second journal housing. The oil seal wear ring means is suitably located at a third position along the length of the journal shaft such as to be cooperatively associated with the latter. The air seal ring means, on the other hand, is suitably located so as to be cooperatively associated with the aforereferenced first journal housing. As such, the air seal ring means is operative for purposes of effecting control over seal air pressure.

DESCRIPTION OF A PREFERRED EMBODIMENT

Figure 1:
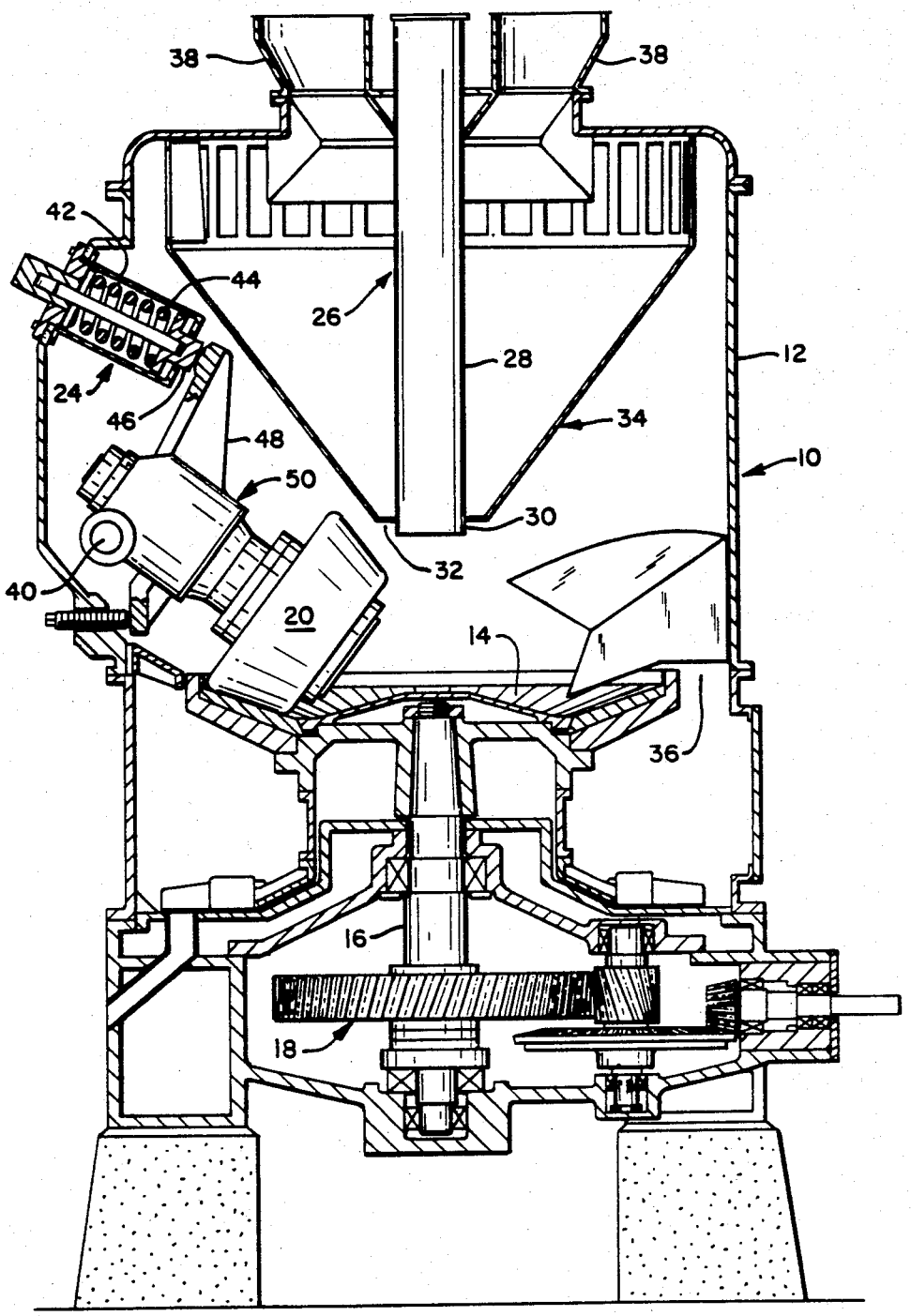
FIG. 1 is a side elevational view partially in section of a pulverizer bowl mill equipped with a journal bearing system constructed in accordance with the present invention.

Referring now to the drawing, and more particularly to FIG. 1 thereof, there is depicted therein a pulverizing bowl mill, generally designated by reference numeral 10, constructed in accordance with the present invention. Inasmuch as the nature of the construction and the mode of operation of pulverizing bowl mills per se are known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of the pulverizing bowl mill 10 embodying an improved journal bearing means in accordance with the present invention to merely present herein a description of the nature of the construction and the mode of operation of the components of the pulverizing bowl mill 10 with which the aforesaid journal bearing means cooperates. For a more detailed description of the nature of the construction and the mode of operation of the components of the pulverizing bowl mill 10, which are not described in depth herein, one may have reference to the prior art, e.g., U.S. Pat.

No. 3,465,971, which issued Sept. 9, 1969 to J. F. Dalenberg et al., and/or U.S. Pat. No. 4,002,299, which issued Jan. 11, 1977 to C. J. Skalka.

Referring further to FIG. 1 of the drawing, the pulverizing bowl mill 10 as illustrated therein includes a substantially closed separator body 12. A grinding table 14 is mounted on a shaft 16, which in turn is operatively connected to a suitable drive means, such as the gear drive generally designated by the reference numeral 18 in FIG. 1, so as to be capable of being rotatably driven thereby. With the aforesaid components arranged within the separator body 12 in the manner depicted in FIG. 1 of the drawing, the grinding table 14 is designed to be driven in a clockwise direction.

Continuing with a description of the pulverizing bowl mill 10, a plurality of grinding rolls 20, preferably three in number in accord with conventional practice, are suitably supported within the interior of the separator body 12 so as to be equidistantly spaced one from another around the circumference of the separator body 12. In the interest of maintaining clarity of illustration in the drawing, only one such grinding roll 20 has been shown in FIG. 1. With further regard to the grinding rolls 20, each of the latter as will be more fully described hereinafter is suitably supported on the journal bearing means which forms the essence of the present invention and which also comprises the subject matter to which the instant application is directed.

Figure 3:
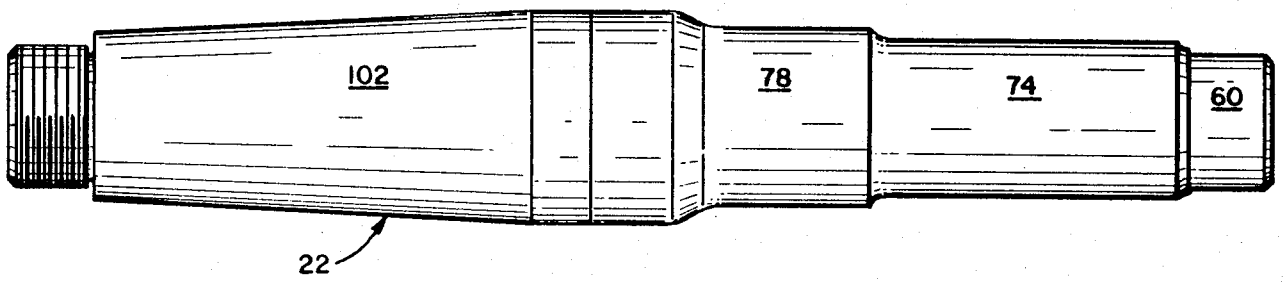
FIG. 3 is a side elevational view of a journal shaft of a journal bearing system constructed in accordance with the present invention.

Suffice it to say at this point, however, that each of the grinding rolls 20 is supported on a shaft, such as that which is generally designated by the reference numeral 22 in FIG. 3. Moreover, each of the shafts 22 in turn is cooperatively associated with some form of biasing means. By way of exemplification, the latter biasing means may take the form of spring means such as that identified by the reference numeral 24 in FIG. 1. On the other hand, the biasing means could also take the form of hydraulic means (not shown). In any event whatever form the biasing means takes, be it the spring means 24 depicted in FIG. 1 or hydraulic means (not shown) the biasing means is intended to be operative to urge the shaft 22 and thereby the grinding roll 20 cooperatively associated therewith towards the surface of the grinding table 14. Commonly, the biasing means is provided with some form of adjustment means, the latter being operative for the purpose of enabling adjustments to be made in the spacing that exists between the grinding roll 20 and the surface of the grinding table 14 on which the pulverization of the material, e.g., coal, occurs.

The material, e.g., coal, that is to be pulverized in the bowl mill 10 is fed thereto by means of any suitable conventional form of feed means. By way of exemplification in this regard, one such feed means that may be employed for this purpose is a belt feeder means (not shown). Upon being discharged from the feed means (not shown), the coal enters the bowl mill 10 by means of a coal supply means, generally designated by reference numeral 26, with which the separator body 12 is suitably provided.

In accordance with the embodiment of the pulverizing bowl mill 10 illustrated in FIG. 1, the coal supply means 26 includes a suitably dimensioned duct 28 having one end thereof which extends outwardly of the separator body 12 and preferably terminates in a funnel-like member (not shown). The latter member (not shown) is suitably shaped so as to facilitate the collection of the coal particles entering the bowl mill 10, and the guiding thereafter of these coal particles into the duct 28. The other end 30 of the duct 28 of the coal supply means 26 is operative to effect the discharge of coal onto the surface of the grinding table 14. To this end, as shown in FIG. 1 of the drawing, the duct end 30 preferably is suitably supported within the separator body 12 through the use of any suitable form of conventional support means (not shown) such that the duct end 30 is coaxially aligned with the shaft 16 that supports the grinding table 14 for rotation, and is located in spaced relation to a suitable outlet 32 provided in the classifier, generally designated by reference numeral 34, through which the coal flows in the course of being fed onto the surface of the grinding table 14.

In accord with the mode of operation of pulverizing bowl mills that embody the form of construction depicted in FIG. 1, a gas such as air is utilized to effect the conveyance of the coal from the grinding table 14 through the interior of the separator body 12 for discharge from the pulverizing bowl mill 10. The air that is used in this connection enters the separator body 12 through a suitable opening formed therein for this purpose. From the aforesaid opening in the separator body 12 the air flows in surrounding relation from beneath the grinding table 14 to above the surface of the latter. More specifically, the air flows through the space, identified by the reference numerals 36 in FIG. 1, provided for this purpose between the inner wall surface of the separator body 12 and the circumference of the grinding table 14. The air upon exiting from the annular spaces 36 is deflected over the grinding table 14 by means of suitably positioned deflector means such as that designated generally by the reference numeral 37 in FIG. 1. One such form of deflector means 37 which is suitable for use for this purpose in the bowl mill 10 of FIG. 1, comprises the subject matter of U.S. Pat. No. 4,234,132 which issued on Nov. 18, 1980, to T. V. Maliszewski, Jr., and which is assigned to the same assignee as the present application.

While the air is flowing along the path described above, the coal which is disposed on the surface of the grinding table 14 is being pulverized by the action of the grinding rolls 20. As the coal becomes pulverized, the particles are thrown outwardly by centrifugal force away from the center of the grinding table 14. Upon reaching the region defined by the circumference of the grinding table 14, the coal particles are picked up by the air which is exiting from the annular spaces 36, and become entrained in the air whereby they are carried along therewith.

This combined flow of air and coal particles is thereafter captured by the deflector means 37, which has been referred to previously hereinabove. The effect of this is to cause this combined flow of air and coal particles to be deflected over the grinding table 14. This necessitates a change in direction in the path of flow of this stream of combined air and coal particles. In the course of effecting this change of direction, the heaviest coal particles, because they have more inertia become separated from the air stream, and fall back onto the surface of the grinding table 14, whereupon they undergo further pulverization. The lighter coal particles, on the other hand, because they have less inertia continue to be carried along in the air stream.

After leaving the influence of the aforesaid deflector means 37 the stream of combined air and coal particles that remains flows to the classifier 34 to which mention has previously been had hereinbefore. The classifier 34, in accord with conventional practice and in a manner which is well-known to those skilled in this art, operates to effect a further sorting of the coal particles that remain in the air stream. Namely, those particles of pulverized coal, which are of the desired particle size, pass through the classifier 34 and along with the air are discharged therefrom and thereby from the bowl mill 10 through the outlets 38 with which the latter is provided for this purpose.

On the other hand, those coal particles, which in size are larger than desired, are returned to the surface of the grinding table 14 whereupon they undergo further pulverization. Thereafter, these coal particles are subjected to a repeat of the previously described process. That is, the particles are thrown outwardly of the grinding table 14, are picked up by the air exiting from the annular spaces 36, are carried along with the air to the deflector means 37, are deflected back over the grinding table 14 by the deflector means 37, the heavier particles drop back onto the grinding table 14, the lighter particles are carried along to the classifier 34, those particles which are of the proper size pass through the classifier 34 and exit from the bowl mill 10 through the outlets 38.

With further regard to the matter of the pulverizing action to which the coal disposed, as viewed with reference to FIG. 1, on the upper surface of the grinding table 14 is subjected by the grinding rolls 20, the amount of force that must be exerted by the latter in order to effect the desired degree of pulverization of the coal will vary depending on a number of factors. For example, one important consideration in this regard is the nature of the coal itself. That is, the amount of force required to pulverize the coal will be a function of the grindability of the coal to be pulverized, i.e., the grinding characteristics of the latter. Another important factor in determining the amount of force that the grinding rolls 20 must exert to accomplish the desired degree of pulverization of the coal is the depth to which the coal is disposed on the grinding table 14, which in turn is a function of the output rate at which the bowl mill 10 is being operated.

As best understood with reference to FIG. 1 of the drawing, the amount of grinding force which the grinding rolls 20 apply to the coal on the grinding table 14 is a function of the amount of force with which the grinding rolls 20 are biased into engagement with the coal on the table 14. In accord with the nature of the construction shown in FIG. 1, the grinding roll 20 depicted therein, which is suitably mounted for rotation in a manner yet to be described, is suitably supported so as to be pivotable about the pivot pin 40 into and out of engagement with the coal that is disposed on the grinding table 14. Although one grinding roll 20 is shown in FIG. 1 and although this discussion is directed to this one grinding roll 20, it is to be understood that as has been mentioned previously hereinbefore the bowl mill 10 is normally provided with three such grinding rolls 20. Therefore, this discussion is intended to be equally applicable to each of the three such grinding rolls 20.

Continuing with the matter of the force exerted by the grinding roll 20, in accord with the nature of the construction illustrated in FIG. 1, the grinding roll 20 is designed to be biased by spring force into and out of engagement with the coal that is on the grinding table 14. More specifically, to this end, the spring means 24 is cooperatively associated with the grinding roll 20. As shown in FIG. 1, the spring means 24 includes a housing 42 suitably mounted on the interior wall surface of the separator body 12. Within the housing 42, a spring 44 is suitably supported for expansion and contraction therewithin. Cooperatively associated with the spring 44 is a member 46 having a portion thereof which projects outwardly of the housing 42. The latter member 46 engages an upstanding member 48 that comprises a portion of the support means for the grinding roll 20. In a manner well-known to those skilled in the spring biasing art, the spring 44 through the member 46 exerts a spring biasing force on the member 48.

Accordingly, the engagement of the member 46 with the member 48 is a function of the force being exerted by the spring 44. In turn, the extent to which the member 46 is biased into engagement with the member 48 by the spring 44 determines the extent to which the grinding roll 20 is spring biased into engagement with the coal on the grinding table 14, and concomitantly the amount of grinding force being applied to the coal by the grinding roll 20.

By way of exemplification, the more the member 46 is biased into engagement with the member 48 by the spring 44, the more the member 46 will be caused to move in a clockwise direction, as viewed with reference to FIG. 1, about the pivot pin 40, and thereby have the effect of increasing the amount of grinding force that the grinding roll 20 exerts on the coal that is on the grinding table 14. Conversely, the less member 46 is biased into engagement with the member 48, the less clockwise movement there will be of the member 48 about the pivot pin 40, and thus the less grinding force the roll 20 will exert on the coal that is resting on the table 14.

In accordance with the present invention, the pulverizing bowl mill 10 embodies new and improved journal bearing means, generally designated in the drawing by reference numeral 50. More specifically, in accord with the best mode embodiment of the invention each of the three grinding rolls 20 with which the bowl mill 10 is provided has cooperatively associated therewith a new and improved journal bearing means 50. Inasmuch as the three journal bearing means 50 are each identical in construction and in mode of operation, it has been deemed sufficient for purposes of obtaining an understanding thereof and in the interest of maintaining clarity of illustration in the drawing to show only one of the three journal bearing means 50 in FIG. 1 of the drawing.

Figure 2:
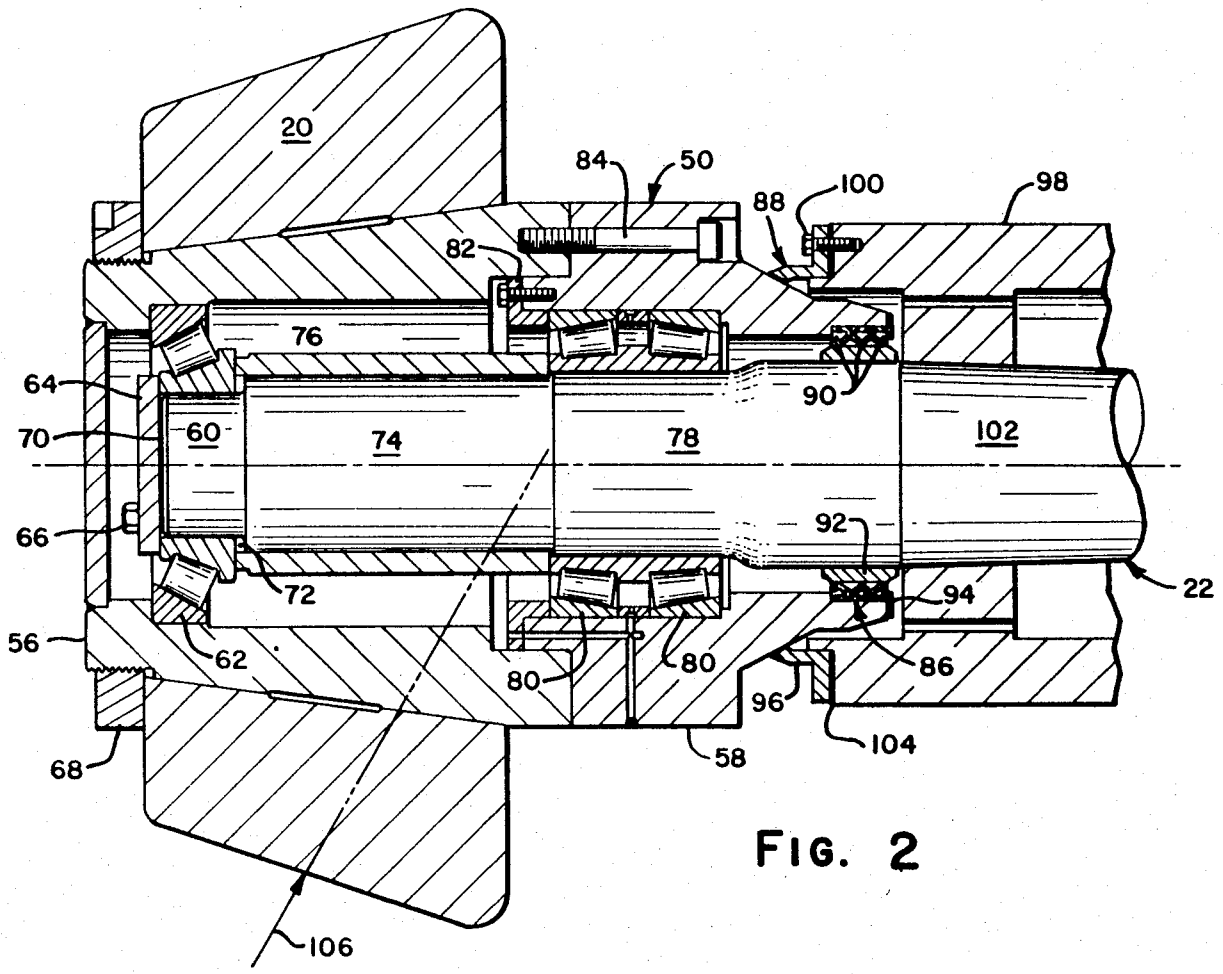
FIG. 2 is a side elevational view partially in section of one embodiment of a journal bearing system constructed in accordance with the present invention, and depicted with a pulverizer roll mounted on the journal shaft.
Figure 4:
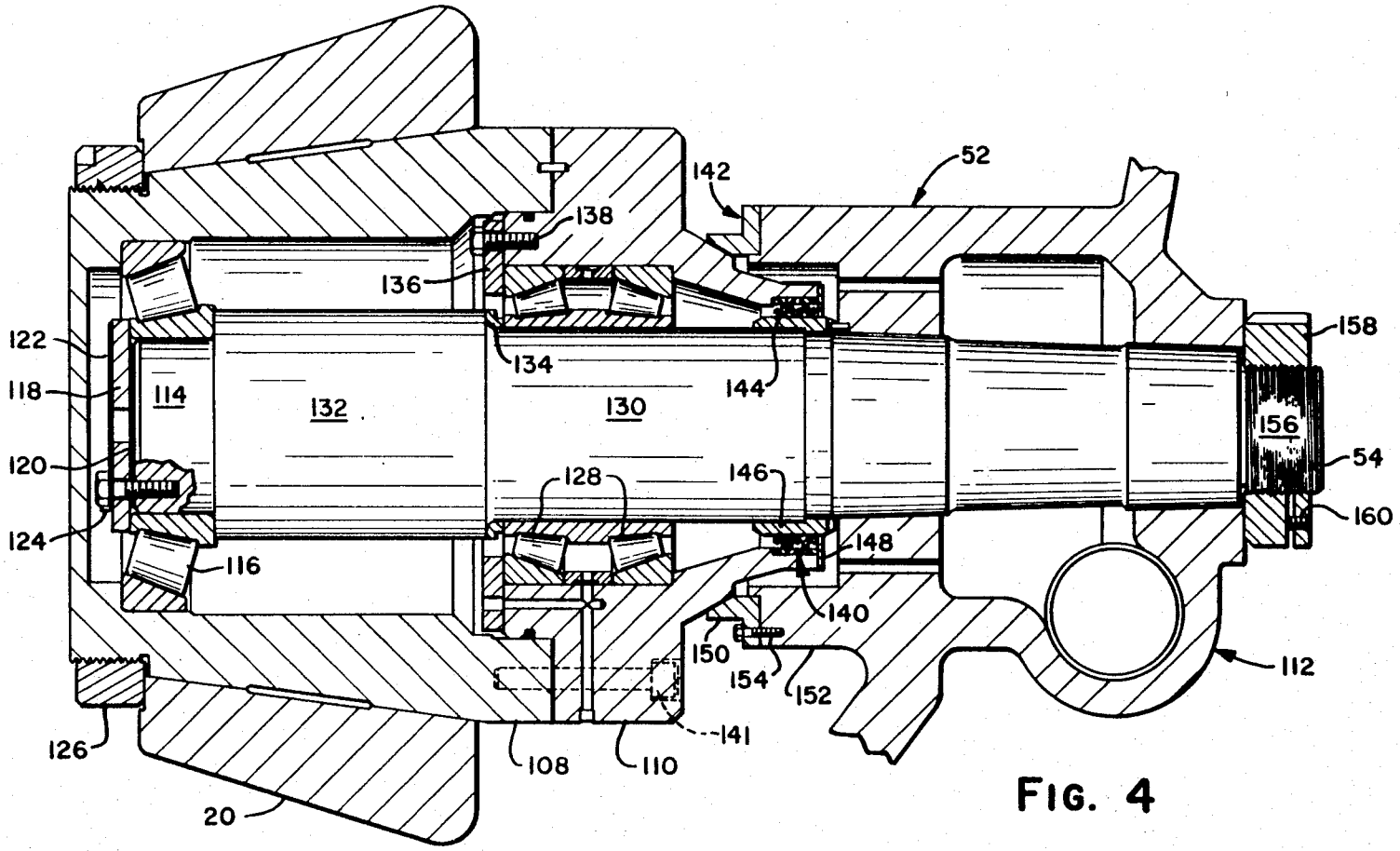
FIG. 4 is a side elevational view partially in section of another embodiment of a journal bearing system constructed in accordance with the present invention, and depicted with a pulverizer roll mounted on the journal shaft.

Turning now to a consideration of the nature of the construction of the journal bearing means 50, reference will be had for this purpose particularly to FIGS. 2–4 of the drawing. More specifically, in this connection reference will be had in particular to FIG. 2 of the drawing wherein there is depicted one embodiment of a journal bearing means 50 constructed in accordance with the present invention, and to FIG. 4 of the drawing wherein a second embodiment, denoted therein by the reference numeral 52, of a journal bearing means constructed in accordance with the present invention is depicted.

Beginning first with the journal bearing means 50, a description will now be had of the nature of the construction and the mode of operation thereof. The journal bearing means 50 is shown in FIG. 2 of the drawing cooperatively associated with a grinding roll 20. Further reference will be had hereinafter to the manner in which the grinding roll 20 is cooperatively associated with the journal bearing means 50.

As seen with reference to FIG. 2 of the drawing, the journal bearing means 50 constructed in accordance with the present invention includes a journal shaft to which reference has been had hereinbefore previously in connection with the matter of the designation thereof by the reference numeral 22 in FIG. 3. In addition to the journal shaft 22, the journal bearing means 50 includes a lower journal housing 56 mounted in surrounding relation to the journal shaft 22, and an upper journal housing 58 which also is mounted so as to be positioned in surrounding relation to the journal shaft 22. The lower journal housing 56 and the upper journal housing 58, as will be best understood with reference to FIG. 2 of the drawings, are each formed so as to embody a substantial thickness. Moreover, by virtue of this added thickness, the strength and rigidity of both the lower journal housing 56 and the upper journal housing 58 is enhanced.

The journal shaft 22, when constructed in the manner as shown in FIG. 2, has a portion of reduced diameter, denoted by the reference numeral 60, formed at one end thereof. Cooperatively associated with the portion 60 of the journal shaft 22 is a lower bearing identified by the reference numeral 62 in FIG. 2. In accord with the best mode embodiment of the invention, the lower bearing 62 comprises a tapered roller bearing. The lower bearing 62 is suitably retained in mounted relation to the portion 60 of the journal shaft 22 by means of a journal bearing keeper 64. The latter in turn is secured to the journal shaft 22 through the use of suitable fastening means, such as threaded fasteners, one thereof being depicted at 66 in FIG. 2.

The grinding roll 20 as seen with reference to FIG. 2 of the drawing is mounted in surrounding relation to the lower journal housing 56. To this end, the grinding roll 20 is retained so mounted relative to the lower journal housing 56 by means of a grinding roll locknut the latter being denoted by the reference numeral 68 in FIG. 2. The lower journal housing 56 is suitably threaded at one end thereof for purposes of enabling the grinding roll locknut 68 to be threadedly engaged therewith.

Continuing, in accord with the best mode embodiment of the invention, a number of members are preferably employed at interspersed locations along the length of the journal shaft 22. These members are intended to function primarily in the manner of spacers. In this regard, reference is had to the journal bearing keeper shim set identified by the reference numeral 70 in FIG. 2. As best understood with reference to the latter Figure, the shim set 70 is suitably interposed between the end surface of the portion 60 of the journal shaft 22 and the journal bearing 64.

Next, a lower bearing spacer 72 is located in surrounding relation to the portion 60 of the journal shaft 22 and so as to be interposed between the tapered roller and a shoulder with which the journal shaft 22 is suitably provided. The latter shoulder is actually formed by the intersection of the portion 60 of the journal shaft 22 with the portion 74 of the journal shaft 22, the portion 74 being of greater diameter than the portion 60.

Yet another spacer member is preferably positioned in surrounding relation to the journal shaft 22. Reference is had here to the journal bearing spacer 76. The latter spacer 76 is suitably positioned relative to the journal shaft 22 so as to essentially encircle the portion 74 thereof. That is, the spacer 76 is suitably dimensioned so as to extend from the rounded shoulder formed at the juncture of the portions 74 and 78 of the journal shaft 22 to a point whereat the spacer 76 is located in juxtaposed relation to the lower bearing spacer 72. As such the spacer 76 has one end thereof positioned basically in abutting relation with the lower bearing 62.

Proceeding further with a description of the journal bearing means 50, as shown in FIG. 2 of the drawing, the journal bearing means 50 also includes an upper bearing, the latter being denoted in FIG. 2 by the reference numeral 80. In accord with the best mode embodiment of the invention, the upper bearing 80 consists of a double bearing with each bearing in the form of a tapered roller bearing. The upper bearing 80 is suitably positioned so as to be located in surrounding relationship to the portion 78 of the journal shaft 22. As best seen from FIG. 2, the portion 78 of the journal shaft 22 has a section thereof which is of reduced diameter as compared to the remainder of the portion 78 of the journal shaft 22. It is with respect to the section of reduced diameter of the portion 78 of the journal shaft 22 that the upper bearing 80 is located in encircling relation.

The upper bearing 80 is retained in the desired location relative to the journal shaft 22 as a consequence of being captured between the upper bearing keeper 82 and the internal surface defined by the bore of the upper journal housing 58. More specifically, as shown in FIG. 2 the upper bearing keeper 82 is located so that it encircles the portion 74 of the journal shaft 22 at the point along the length of the latter shaft 22 whereat the upper journal housing 58 mates with the lower journal housing 56.

In accordance with the illustration of FIG. 2, the upper journal housing 58 is joined to the lower journal housing 56 through the use of conventional fastening means. More specifically, the joinder of the upper and lower journal housings 58 and 56, respectively, is accomplished through the use of threaded fasteners, one of which is seen at 84 in FIG. 2 of the drawing.

Two other important features of the journal bearing means 50, constructed as shown in FIG. 2, remain to be described. The first of these comprises the oil seal means, which is designated generally in FIG. 2 by the reference numeral 86, and the other is the air seal means, which is denoted generally in FIG. 2 by reference numeral 88. Insofar as the oil seal means 86 is concerned, the latter is suitably supported so as to be located in interposed relation between the section of the portion 78 of the journal shaft 22 which is of enlarged diameter, and the end portion of the upper journal housing 58 which is not affixed to the lower journal housing 56. More specifically, the oil seal means 86 includes oil seal 90 which consists of a plurality of oil seals that preferably ride on a wear ring 92, the surface of which is preferably provided with a plating of a suitable material such as chromium. Further, the oil seal means 86 includes an oil seal keeper 94 which is suitably secured such as through the use of conventional threaded fasteners (not shown) to the end face of the upper journal housing 58.

Regarding next the air seal means 88, the latter includes a skirt-like member 96, which is suitably dimensioned so as to extend in surrounding relation to the end portion of the upper journal housing 58, which is not affixed to the lower journal housing 56. Moreover, the skirt-like member 96 is suitably positioned relative to the upper journal housing 58 as a consequence of being suitably fastened to the end face of the journal head 98. In this regard, the skirt-like member 96 is preferably affixed to the journal head 98 through the use of a conventional form of fastening means, such as threaded fasteners, one of which is illustrated at 100 in FIG. 2. Note is made here of the fact that the journal head 98 is in turn suitably positioned such as to effect an encirclement of that portion of the journal shaft 22, which has been designated in FIG. 2 by the reference numeral 102. Moreover, with reference to FIG. 2, it can be seen therefrom that the portion 102 of the journal shaft 22 in accordance with the illustrated form of construction of the journal bearing means 50 is dimensioned such that the external surface thereof is tapered to a measurable extent.

The journal bearing means 50 constructed in accordance with the showing thereof depicted in FIG. 2 of the drawing, is advantageously characterized in a number of respects. To this end, note is first taken of the fact that the upper bearing 80 is suitably positioned such that the radial load imposed thereupon is reduced. Namely, the upper bearing 80 is located relative to the journal shaft 22 such that the resultant load acts within the bearing span, as depicted by the arrow identified by the reference numeral 106 in FIG. 2. Secondly, inasmuch as the upper bearing 80 takes the form of a double row of bearings any induced thrust load thereon is cancelled internally. Moreover, by employing an upper bearing 80 that comprises a double bearing, the capacity of the bearing at the upper bearing position is doubled.

A further advantageous feature of the journal bearing means 50 resides in the oil seal means 86. The latter as described previously hereinbefore includes a hardened seal wear ring 92. As such the oil seals 90 cannot wear grooves in the journal shaft 22. Moreover, the wear ring 92 can be replaced inexpensively if it becomes grooved. Lastly, an oil seal keeper 94 is preferably employed. By virtue of the use thereof, the oil seals 90 are prevented from coming out of the upper journal housing 58 during operation.

Yet another advantageous feature of the journal bearing means 50 resides in the air seal means 88. The latter embodies a tapered configuration and is capable of being adjusted relative to the external surface of the upper journal housing 58. This capability regarding adjustment of the air seal means 88 facilitates the effectuation of control of the seal air pressure. The aforesaid adjustment is effected by the emplacement of suitably dimensioned shims 104 between the skirt-like member 96 and the journal head 98. The insertion of the aforesaid shims 104 is accomplished by the removal of the threaded fasteners 100, the emplacement of the shims 104 and the subsequent return of the threaded fasteners 100 into threaded engagement with the journal head 98.

A number of benefits accrue from the fact that the journal bearing means 50 embodies the advantageous features enumerated above. To this end, the reduction in load which is applied to the bearings concomitant with the increase in capacity that the bearings possess produces an increase in bearing life. Moreover, the result of achieving an increase in bearing life is that a reduction in maintenance requirements and material costs is realized. In addition, the reduction in the load that is applied to the bearings, and the increase in capacity possessed by the bearings has the effect of improving the reliability of the bearings. As concerns the matter of reliability, the use of oil seal means and air seal means constructed in accordance with the showing of the oil seal means 86 and the air seal means 88 seen in FIG. 2 further increases the reliability of the journal bearing means 50 by virtue of the fact that the oil seal means 86 and the air seal means 88 reduce the possibility of contamination. A further benefit derived from the employment of the journal bearing means 50 resides in the fact that the latter is relatively inexpensive to provide. In conclusion, the journal bearing means 50 constructed in accordance with the showing thereof in FIG. 2 is particularly suited for use in retrofit applications.

Turning now in particular to FIG. 4 of the drawing, a description will be had with reference thereto to another embodiment of journal bearing means constructed in accordance with the present invention. More specifically, a description will now be had of the nature of the construction of the journal bearing means 52 as illustrated in FIG. 4. As depicted in FIG. 4 the journal bearing means 52 has a grinding roll 20 cooperatively associated therewith. The manner in which the grinding roll 20 is cooperatively associated with the journal bearing means 52 will be described more fully hereinafter.

Referring to FIG. 4 of the drawing, the journal bearing means 52 includes a journal shaft 54, a lower journal housing 108, an upper journal housing 110, and a journal head and trunnion shaft assembly, the latter being designated generally by the reference numeral 112 in FIG. 4. The lower journal housing 108, the upper journal housing 110, and the journal head and trunnion shaft assembly 112 are each suitably supported in mounted relation to the journal shaft 54 such as to each be positioned in surrounding relation thereto. The lower journal housing 108 and the upper journal housing 110, as will be best understood with reference to FIG. 4 of the drawing, are each formed so as to embody a substantial thickness. Moreover, by virtue of this added thickness, the strength and rigidity of both the lower journal housing 108 and the upper journal housing 110 is enhanced.

The journal shaft 54, when constructed in accordance with the showing thereof in FIG. 4, has a first portion of reduced diameter denoted by the reference numeral 114, formed at one end thereof. The portion 114 of the journal shaft 54 has a lower bearing, identified by the reference numeral 116 in FIG. 4, cooperatively associated therewith. The lower bearing 116 in accord with the best mode embodiment of the invention comprises a tapered roller thrust bearing. For purposes of retaining the lower bearing 116 in mounted relation relative to the reduced portion 114 of the journal shaft 54 a journal bearing keeper 118 is preferably employed. Moreover, in accord with the embodiment of the invention illustrated in FIG. 4 of the drawing, a journal bearing keeper shim set 120 is preferably utilized in interposed relation between the end face of the portion 114 of the journal shaft 54 and the journal bearing keeper 118. Lastly, a journal cap screw lock plate 122 is secured in juxtaposed relation to the journal bearing keeper 118 by means of any suitable conventional form of fastening means, such as threaded fasteners, only one of which is depicted at 124 in FIG. 4. As seen with reference to FIG. 4 of the drawing, the grinding roll 20 is mounted in surrounding relation to the lower journal housing 108. For purposes of mounting the grinding roll 20 in secured relation to the lower journal housing 108, a grinding roll locknut 126 is preferably employed. To this end, the lower journal housing 108 is suitably threaded at one end thereof for purposes of enabling the grinding roll locknut 126 to be threaded thereon in threaded engagement therewith.

Proceeding further with a description of the journal bearing means 52, the latter as shown in FIG. 4 of the drawing also includes an upper bearing, the latter being denoted in FIG. 4 by the reference numeral 128. In accord with the best mode embodiment of the invention, the upper bearing 128 consists of a double bearing with each bearing comprising a tapered roller thrust bearing. The upper bearing 128 is suitably positioned so as to be located in surrounding relation to the portion 130 of the journal shaft 54. As best understood with reference to FIG. 4, a shoulder is formed between the portion 130 which is of reduced diameter of the journal shaft 54 and the portion of the journal shaft 54 denoted by the reference numeral 132. A bearing spacer 134 is suitably interposed in juxtaposed relation to the aforedescribed shoulder. Moreover, the bearing spacer 134 functions to effect a proper spacing of the upper bearing 128 relative to the aforedescribed shoulder.

The upper bearing 128 is retained in the desired location relative to the journal shaft 54 as a consequence of being captured between the upper bearing keeper 136 and the internal surface defined by the bore of the upper journal housing 110. That is, the upper bearing keeper 136 as seen with reference to FIG. 4 is positioned in surrounding relation to the portion 130 of the journal shaft 54 and in spaced relation to the bearing spacer 134. In accordance with the illustration of FIG. 4, the upper bearing keeper 136 is fastened to the upper journal housing 110 by means of conventional fastening means, such as the threaded fastener 138.

Preferably, the upper journal housing 110 and the lower journal housing 108 are joined together through the use of conventional fastening means. More specifically, the joinder of the upper and lower journal housings 110 and 108, respectively, is in accord with the best mode embodiment of the invention accomplished through the use of threaded fasteners, one of which is depicted in phantom lines at 141 in FIG. 4 of the drawing.

There remains to be described two other important features of the journal bearing means 52. Reference is had here to the oil seal means designated generally by the reference numeral 140 in FIG. 4 of the drawing, and to the air seal means denoted in FIG. 4 generally by the reference numeral 142. Considering first the oil seal means 140, the latter is suitably positioned in interposed relation between the portion 130 of the journal shaft 54 and the end portion of the upper journal housing 110 that is not affixed to the lower journal housing 108. The oil seal means 140 in accord with the best mode embodiment of the invention includes oil seal 144 which consists of a plurality of individual oil seals, three in number in accord with the illustration of FIG. 4. The oil seal 144 preferably rides on a seal wear ring 146. The surface of the latter is preferably provided with a plating of a suitable material such as chromium. Lastly, the oil seal means 140 includes an oil seal keeper 148 that is suitably secured such as through the use of conventional threaded fasteners (not shown) to the end face of the upper journal housing 110.

Turning next to a consideration of the air seal means 142, the latter includes a member 150 which is suitably dimensioned so as to extend in surrounding relation to the end portion of the upper journal housing 110 that is not affixed to the lower journal housing 108. Further, the member 150 is provided with a suitably tapered surface such that the taper of the latter is substantially complementary to the taper of the upper journal housing 110. Moreover, the member 150 is suitably positioned relative to the upper journal housing 110 by virtue of being suitably fastened to the end face of the journal head and trunnion shaft assembly 112. To this end, the member 150 is preferably affixed to the journal head 152 through the use of a conventional form of fastening means, such as threaded fasteners, one of which is illustrated at 154 in FIG. 4.

With further regard to FIG. 4 of the drawing, it can be seen therefrom that the journal head and trunnion shaft assembly 112 is suitably positioned such as to effect an encirclement of the remaining portions of the journal shaft 54. Moreover, it can be seen by reference to FIG. 4 that the aforesaid remaining portions of the journal shaft 54 in accord with the illustration of FIG. 4 are dimensioned such that the external surface thereof has a measurable taper to it. Finally, the other end 156 of the journal shaft 54 preferably is suitably threaded so as to be capable of receiving in threaded engagement therewith a locknut 158 with set screw 160.

In a number of respects the journal bearing means 52 of FIG. 4 is advantageously characterized. The first of these resides in the fact that the upper bearing 128 is suitably positioned such that the residual load applied thereto is reduced. That is, the upper bearing 128 is located relative to the journal shaft 54 such that the resultant load acts within the bearing span of the former. Secondly, since the upper bearing 128 comprises a double row of bearings, any induced thrust load applied thereto is cancelled internally. Further, the capacity of the bearing 128 at the upper bearing position is doubled by virtue of the fact that an upper bearing 128 comprising a double bearing is employed.

Another advantageous feature of the journal bearing means 52 resides in the use therein of the oil seal means 140. As has been described previously hereinbefore, the oil seal means 140 includes a hardened seal wear ring 146. Therefore, the oil seals 144 cannot wear grooves in the journal shaft 54. In addition, the seal wear ring 146 can, if it becomes grooved, be replaced inexpensively. Also, as has been described above, the oil seals 144 are prevented from becoming displaced by virtue of the employment of the oil seal keeper 148 which functions to keep the oil seals 144 suitably emplaced during operation within the upper journal housing 110.

The journal bearing means 52 is advantageously characterized in yet another respect by virtue of the embodiment therein of the air seal means 142. The latter air seal means 142 is provided with a tapered configuration and is capable of being adjusted relative to the external surface of the upper journal housing 110. Control of the seal air pressure is facilitated by virtue of the fact that the air seal means 142 possesses the capability of being adjusted. This adjustment of the air seal means 142 is effected by emplacing suitably dimensioned shims, which in the interest of maintaining clarity of illustration of the drawing have not been depicted in FIG. 4, between the member 150 and the end face of the journal head 152 of the journal head and trunnion shaft assembly 112. The insertion of the aforementioned shims (not shown) is accomplished by the removal of the threaded fasteners 154, the emplacement of the shims (not shown) and the subsequent rethreading of the threaded fasteners 154 into threaded engagement with the journal head 152.

A number of benefits accrue from the fact that the journal bearing means 52 embodies the features of an advantageous nature enumerated above. Namely, the reduction in load which is applied to the bearings concomitant with the increase in capacity that the bearings possess produces an increase in bearing life. Further, the result of achieving an increase in bearing life is that a reduction in maintenance requirement and material cost is realized. Also, the reduction in the load that is applied to the bearings, and the increase in capacity possessed by the bearings has the effect of improving the reliability of the bearings. With regard to the matter of reliability, the use of oil seal means and air seal means constructed in accordance with the showing of the oil seal means 140 and the air seal means 142 seen in FIG. 4 further increases the reliability of the journal bearing means 52 by virtue of the fact that the oil seal means 140 and the air seal means 142 reduce the possibility of contamination. Another benefit derived from the employment of the journal bearing means 52 resides in the fact that the latter is relatively inexpensive to provide. To conclude, the journal bearing means 52 constructed in accordance with the showing thereof in FIG. 4 is particularly suited for use in new applications.

Thus, in accordance with the present invention there has been provided a new and improved journal bearing system that is suitably constructed so as to be employable in a bowl mill. Moreover, the journal bearing system for bowl mills of the present invention is constructed such that the radial loading on the upper bearing thereof has been reduced. In addition, in accord with the present invention the journal bearing system for bowl mills is constructed such that the thrust loading on the lower bearing thereof has been reduced. Further, the journal bearing system for bowl mills of the present invention is constructed such that the capacity of the upper bearing thereof is increased. Additionally, in accordance with the present invention the journal bearing system for bowl mills embodies an improved oil seal design. Also, the journal bearing system for bowl mills of the present invention embodies an improved air seal design. Furthermore, in accord with the present invention a journal bearing system for bowl mills is provided which is suitable for employment in newly constructed bowl mills, while yet being equally well suitable for utilization in retrofit applications.

While two embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

What is claimed is:

1. A pulverized bearing system operative for providing bearing support for a pulverizer roll in a bowl mill comprising:

a. a journal shaft embodying a multiplicity of portions of differing dimensions, said journal shaft including a first portion having a first diameter, a second portion having a second diameter, a third portion having a third diameter and a fourth portion having a fourth diameter;

b. a lower bearing supported in surrounding relation to said first portion of said journal shaft, said lower bearing being operative to provide a first bearing support for said journal shaft;

c. a lower journal housing supported in surrounding relation to said second portion of said journal shaft, said lower journal housing being operative to retain said lower bearing in supported relation on said journal shaft, said lower journal housing further being operative to receive the pulverizer roll in mounted relation thereon;

d. an upper bearing supported in surrounding relation to said third portion of said journal shaft, said upper bearing being operative to provide a second bearing support for said jounal shaft, said upper bearing being spaced a predetermined distance along the length of said journal shaft from said lower bearing so that the resultant force acting on said journal shaft acts within the bearing span defined by said upper bearing and said lower bearing;

e. oil seal wear ring means supported in surrounding relation to said journal shaft, said oil seal wear ring means being operative to provide said journal shaft with an oil seal;

f. an upper journal housing supported in surrounding relation to said third portion of said journal shaft, said upper jounal housing being operative to retain both said upper bearing and said oil seal wear ring means in supported relation on said journal shaft;

g. a journal head supported in surrounding relation to said fourth portion of said journal shaft; and h. an air seal ring means supported on said journal head so as to be positioned in engagement with the exterior surface of said upper journal housing, said air seal ring means being operative to effectuate control over seal air pressure.

2. The pulverizer journal bearing system as set forth in claim 1 wherein said lower bearing comprises a tapered roller thrust bearing.

3. The pulverizer bearing system as set forth in claim 2 wherein said upper bearing comprises a pair of tapered roller thrust bearings.

4. The pulverizer journal bearing system as set forth in claim 1 wherein said oil seal wear ring means comprises a seal wear ring encircling said journal shaft and a multiplicity of oil seals supported so as to be in engagement with said seal wear ring.

5. The pulverizer journal bearing system as set forth in claim 1 wherein said air seal ring means comprises a member having a tapered face, said member being affixed to said journal head so that said tapered face of said member engages the exterior surface of said upper journal housing.

6. The pulverizer journal bearing system as set forth in claim 5 wherein said air seal ring means is adjustable.

* * * * *

UNITED STATES PATENT AND TRADEMARK OFFICE

CERTIFICATE OF CORRECTION

PATENT NO. : 4,538,768

DATED : September 3, 1985

INVENTOR(S) : Frank J. Paskowski, Jr. and Peter L. Stanwicks

It is certified that error appears in the above—identified patent and that said Letters Patent is hereby corrected as shown below:

Column 15, line 47, "pulverized" should read --pulverizer journal--.

Column 16, line 40, after "pulverizer" should be inserted --journal--.

Signed and Sealed this

*Sixth* Day of *May 1986*

[SEAL]

*Attest:*

DONALD J. QUIGG

*Attesting Officer*

*Commissioner of Patents and Trademarks*